US006227281B1

(12) United States Patent
Martin

(10) Patent No.: US 6,227,281 B1
(45) Date of Patent: May 8, 2001

(54) SECTIONAL DOOR WITH ROLLER SHIELD APPARATUS

(75) Inventor: David O. Martin, Salt Lake City, UT (US)

(73) Assignee: Martin Door Manufacturing, Inc., Salt Lake City, UT (US)

( * ) Notice: Subject to any disclaimer, the term of this patent is extended or adjusted under 35 U.S.C. 154(b) by 0 days.

(21) Appl. No.: 09/377,576

(22) Filed: Aug. 19, 1999

Related U.S. Application Data

(63) Continuation-in-part of application No. 09/152,235, filed on Sep. 11, 1998, now Pat. No. 6,125,506.

(51) Int. Cl.[7] ..... E05D 15/16
(52) U.S. Cl. ..... 160/201; 16/91; 49/197
(58) Field of Search ..... 160/201, 207, 160/40; 49/197, 201, 460; 16/91, 97, 107

(56) References Cited

U.S. PATENT DOCUMENTS

| | | | |
|---|---|---|---|
| 1,037,010 | 8/1912 | Irons . | |
| 1,603,379 | 10/1926 | Dautrick . | |
| 1,890,348 | 12/1932 | Weatherhead, Jr. . | |
| 2,321,157 | 6/1943 | Rees | 85/36 |
| 2,351,803 | 6/1944 | Best | 296/44 |
| 2,369,493 | 2/1945 | Rood | 160/201 |
| 2,507,690 | 5/1950 | Burns | 160/172 |
| 2,655,684 | 10/1953 | Robinson | 16/207 |
| 2,962,923 | 12/1960 | Stock | 85/8.8 |
| 3,412,780 * | 11/1968 | Moler . | |
| 4,120,072 | 10/1978 | Hormann | 16/87 R |
| 4,793,397 | 12/1988 | Whiteman | 160/201 |
| 4,834,603 | 5/1989 | Holton | 411/521 |
| 5,172,744 * | 12/1992 | Finch et al. . | |
| 5,630,459 | 5/1997 | Martin | 160/236 |
| 5,743,057 | 4/1998 | Martin | 52/457 |
| 5,954,111 | 9/1999 | Ochoa | 160/201 |
| 6,125,506 * | 10/2000 | Martin | 16/91 |

FOREIGN PATENT DOCUMENTS

| | | | |
|---|---|---|---|
| 63265 | 12/1912 | (CH) | 160/201 |
| 3331968 * | 3/1985 | (DE) | 49/197 |
| WO 98/10165 | 3/1998 | (WO) . | |

* cited by examiner

*Primary Examiner*—Blair M. Johnson
(74) *Attorney, Agent, or Firm*—Kirton & McConkie; Berne S. Broadbent; Dale E. Hulse

(57) ABSTRACT

A sectional door is disclosed that includes a safety system. The safety system includes a shield apparatus, an improved support track, reverse angle track shields, and hemmed roller track edges to prevent injury or harm to body parts errantly placed within or around the support track during the opening or closing of the sectional door. The sectional door includes a plurality of door sections hingedly joined in an edge-to-edge relationship to form the completed sectional door. The sectional door further include support rollers attached to the door sections, and a pair of support tracks, in which the support rollers are confined. Each support roller further includes a circular or rectangular roller shield that is mounted to the axle of the support roller outside of the support track where it is proximate the support track in such a manner as to limit or prevent any fingers from engaging within the support track with the support rollers. The dimensions of the protective shield is larger than the support rollers so as to provide adequate shielding for the support roller. Protective shield wings are provided to enclose the support track and prevent objects from interfering with the roller as well as to provide transport guidance within the support track where track sections meet. Further, the outer edge of the protective shield is blunted or protected in a manner to prevent harm during operation. The reverse angle track shields are constructed of a solid metal piece so as to prevent objects from passing between the support track and a mounting surface. Additionally, the adjacent edge of the support track is also formed into a folded single hem, either outwardly or inwardly, to prevent fingers from being cut as the fingers are brushed aside by the roller shield.

13 Claims, 8 Drawing Sheets

SECTIONAL DOOR WITH ROLLER SHIELD APPARATUS

RELATED APPLICATIONS

This application is a continuation in part application of U.S. patent application Ser. No. 09/152,235 entitled SHIELD APPARATUS AND SUPPORT TRACK AND METHOD FOR A SUPPORT ROLLER OF A SECTIONAL DOOR filed Sep. 11, 1998 now U.S. Pat. No. 6,125,506.

BACKGROUND OF THE INVENTION

The present invention relates generally to a sectional door having a support track and support rollers and, more particularly, the present invention relates to a track safety system for use with sectional doors. More particularly still, the present invention relates to a sectional door having a shield apparatus as a safety device for the rollers engaged in the support track.

Sectional doors are used in various applications such as garage doors, storage doors, and industrial doors. A sectional door typically consists of a plurality of door sections that are hinged in an edge-to-edge relationship to form the completed sectional door. The ends of each door section are supported upon support rollers, which are confined to support tracks mounted adjacent the opening of the facility, such as a garage. Each support track has a vertical section and a horizontal section with a curved section, usually as part of the horizontal track, providing transition between the vertical and horizontal direction. The vertical section of track supports the sectional door in its vertical or closed position across the opening while the horizontal section supports the sectional door in its overhead or open position. The hinges between the door sections allow the sectional door to traverse the curved section of track between the vertical and horizontal orientations.

The support track is fabricated from a strip of sheet metal that has been formed with a generally J-shaped cross section so that the support roller is constrained by the curved portion of the J-shape. The axle of the support roller extends outwardly and is anchored to the adjacent door section. The upper end of the J-shaped cross section is formed as a flange extending orthogonally from the leg of the J-shape to provide the support track with an overall cross sectional profile that is a modified C-shaped profile. The curve of the J-shape supports the roller while the flange prevents the roller from jumping the track. Dimensionally, the length of the J-shape is about 5 or 6 centimeters while the width of the curved portion of the J-shape is about 3 centimeters. The flange is larger than 3 centimeters.

A primary use of a sectional doors is in a residential setting, which typically includes children playing in and out of the garage. Children enjoy playing with things that move, but do not always appreciate the inherent dangers of the object with which they play. For example, residential sectional doors are provided with electrically driven openers to move the sectional doors between their open and closed positions. On occasion, children insert one or more fingers into the interior of the "J" shaped track during movement of the sectional door, which results in one of the support rollers either severely crushing or amputating the child's fingers. Further, the support roller has a diameter of less than 5 centimeters, which means that the angular opening between the periphery of the support roller and the support track is sufficient to receive a child's finger. The size of a child's finger coupled with the dimensions of the support roller and support track tends to pull the rest of the child's finger under the support roller during the continued rolling movement of the support roller.

One solution to guarding against fingers being inserted in a support track near the support rollers is to provide a barrier in front of the support roller. An example of such a support barrier is illustrated in Patent Cooperation Treaty Application No. PCT/DK97/00339, published Mar. 12, 1998. This reference teaches of providing a finger blocking disc, which is made of plastic, at each roller. The disc extends beyond the free edges of the support track and is designed to prevent fingers from being carelessly caught between the stationary support track and one or more of the support rollers during the opening or closing of the sectional door. The disc has a hub that is mounted with a forced fit on the shaft to which the support roller is mounted. The disc is locked in place with a locking ring. The disc also has an enlarged bead about the circumference to prevent the disc from cutting into or harming any fingers that might stray within the support track.

Unfortunately, the PCT Application No. PCT/DK97/00339 suffers from several drawbacks. One drawback is that the edge of the roller track is a cut, bare metal sheet that has a sharp edge. This sharp edge can still cut the fingers of anyone placing their hand within the support track either with or without the support rollers pinching on the fingers. Secondly, the sharp edge of the support track can also cut the fingers of someone placing their hand within the support track by the protective disc, which can easily press the fingers along or into the sharp edge of the support track. Referring now to FIG. 12 (PRIOR ART) support track 30 and roller assembly 20 are shown in the environment of a child's finger 40. Portions of curved section 32 are broken away to schematically illustrate what happens when finger 40 is placed inside support track 30 during movement of roller assembly 20. Movement of roller assembly 20 is shown schematically by movement arrow 42 that causes roller 22 to rotate as shown schematically by rotation arrow 44. This rolling action of roller 22 grips the tip of finger 40 against the inside surface of curved section 32 thereby holding finger 40 from being retracted. Continued movement of roller assembly 20 causes roller 22 to ride over finger 40 with the net effect that finger 40 is "pulled" under roller 22 as shown schematically by pulling arrow 46. Clearly, finger 40 is subjected to substantial injury by being crushed between roller 22 and the surface of J-shaped track section 32. Additionally, if finger 40 is only pushed across the exposed edge of curved section 32 finger 40 will most probably be cut by this action.

Another disadvantage with the prior art disc is that the retaining ring and the flange used to secure the protective disc on the support shaft can work loose causing the protective disc to move away from the opening in the support track. Without the protective disc guarding the support track in close proximity, fingers can get caught in the track as the door operates by being caught by the support rollers moving within the support track.

Another drawback with the disk disclosed in PCT Application No. PCT/DK97/003339 is that the disk must be sufficiently large in order for fingers not to come in contact with the support rollers during travel. This means that the disk can extend over the track portion and be broken if it is made of an inferior material. Further, children can be imaginative enough to insert something long and thin that rides in the track and is not deflected out of the track during travel. Such an item may be a stick, a toy, or the like. Failure to deflect the object could lead to a damaged track or roller, or to a stuck door that is inoperable.

Furthermore, the metal tracts in which the guide rollers travel typically have openings in them that are used for security purposes. Namely, a latch fits into one of the openings to hold the door in place. The latch can be released by a handle with a lock on it. This provides a means for locking and securing the door in a closed position. Unfortunately, a garage door opener is used in many cases to provide this security feature. Thus, the universal track with the latch openings allows a child to insert his or her fingers through the track during operation, which has been shown previously to lead to injured or severed fingers.

Accordingly, what is needed is a complete safety system for a sectional door that includes an improved protective device for shielding the support rollers and support track to prevent injury by cutting or being pinched along the support track or between the support track and the support rollers. Furthermore, what is needed is a protective device that is secured on the support shaft near the support track and support rails in such a manner as to prevent the protective disc from coming free and failing to perform the protective function desired. Also, what is needed is a support roller guide that prevents items from slipping past the protective disc and engaging with the support rollers while maintaining a fixed orientation with respect to the tract as it transitions from a horizontal to a vertical orientation and vice versa. Further, what is needed is a latch opening that is prevents penetration should no security latch be required or used with the garage door.

SUMMARY OF THE INVENTION

According to the present invention, a sectional door is disclosed that includes a safety system that includes a shield apparatus and improved support track to prevent injury or harm to body parts errantly placed within the support track during the opening or closing of the sectional door. The sectional door includes a plurality of door sections that are hinged together in an edge-to-edge relationship to form the completed sectional door. The sectional door further include support rollers attached to the door sections, and a pair of support tracks, in which the support rollers are confined. The support tracks are attached to a surface via a reverse angle shield, which prevents anything from passing between the track and the wall. Each support track includes at least one latch opening knock-out, which remains in place where no latch is needed for locking purposes, but may be removed should a latch and lock be added to the sectional door. The knock-outs prevent children from inserting fingers through the latch openings when no latch is added. Further, a latch cover is provided where a latch opening has been made to prevent insertion of fingers into the opening when the latch is not engaged therein.

Each support roller further includes a protective roller shield, which may be rectangular, oval, or generally elongated in shape, which is mounted to the axle of the support roller outside of the support track where it is proximate the support track in such a manner as to limit or prevent any fingers from engaging within the support track with the support rollers. The dimensions of the protective roller shield is larger than the support rollers to provide adequate shielding for the support roller. The protective shield also includes a pair of shield wings that insert into the track and shield the support rollers so no items can engage therewith. The shield wings are formed in such a way to guide the roller shield through track transitions from a first track section to a second track section. A bridge may also be provided that joins the opposing shield wings so as to shield one edge of the support track that may not extend the same distance as the other edge of the support track.

Further, the outer edge of the protective roller shield is blunted or protected in such a way as not to cause harm during operation. Additionally, the adjacent edge of the support track is also formed into a folded single hem, either outwardly or inwardly; to prevent fingers from being cut as the fingers are brushed aside by the roller shield. The track also has no holes or openings greater than 0.350" in diameter, thus preventing small fingers from being inserted into the path of the roller wheels through the track where the roller shield is ineffectual. Latch knockouts may still be provided, but are covered by latch covers during use.

The protective roller shield is mounted to the axle in such a manner that it does not travel along the axle during operation. Additionally, the protective roller shield includes a center opening having a diameter approximate that of the support axle. The inner diameter is formed by a plurality of radially formed resilient tines that are separated from one another in a manner that allows the roller shield to fit over an object having a larger diameter than the inner diameter of the protective roller shield for placement within a retaining annular located on the support axle proximate the support rollers.

These and other features of the present invention will become more readily apparent from the following description in which specific embodiments of the invention have been set forth in conjunction with the accompanying drawing and appendant claims.

BRIEF DESCRIPTION OF THE DRAWINGS

In order that the manner in which the above-recited and other advantages and objects of the invention are obtained, a more particular description of the invention briefly depicted above will be rendered by reference to a specific embodiment thereof which is illustrated in the appended drawings. With the understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PRESENT INVENTION

The figures listed above are expressly incorporated as part of this detailed description.

It will be readily understood that the components of the present invention, as generally described and illustrated in the Figures herein, could be arranged and designed in a wide variety of different configurations. Thus, the following more detailed description of the embodiments of the system and apparatus of the present invention, as represented in FIGS. 1 through 11, is not intended to limit the scope of the invention, as claimed, but it is merely representative of the present specific embodiments of the invention.

Figure 1:
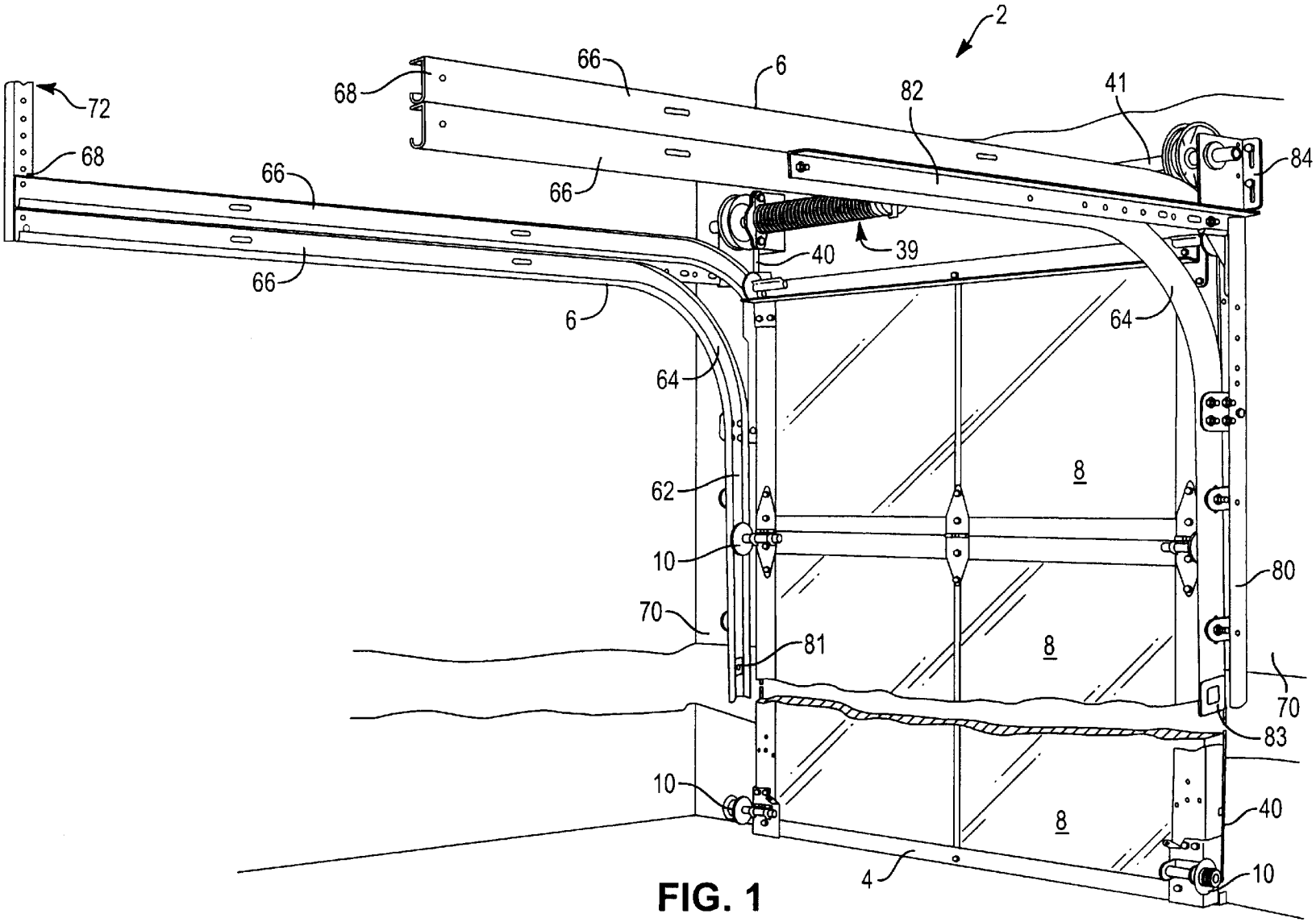
FIG. 1 is a perspective view of a sectional door having support tracks and support rollers that incorporate the protective safety system in accordance with principles of the present invention.

FIG. 1 illustrates a perspective view of a sectional door 2 in accordance with the present invention. Sectional door 2 further includes a door unit 4, which comprises a plurality of sectional door units 8, and a pair of support tracks 6, which are mounted in a spaced apart mirror-fashion so that door 4 is supported by support tracks 6. Sectional door 2 further comprises a plurality of support rollers 10, which are evenly spaced along the outer edges of the door section 8. Support rollers 10 are utilized to travel within support tracks 6 so as to open and close door 4 as needed. Support rollers 10, as well as a cross-section of support track 6, are shown in greater detail in FIGS. 2–11 as described below.

This inventive system utilizes a torsion spring assembly 39, which is connected by a lift 40 to sectional roll-up door 4. The roll-up sectional door rides on rollers 10, which engage and travel within tracks 6 at each side of the door 4. These tracks typically comprise a vertical track 62, which is connected to a horizontal track 66, which includes an arcuate track 64. Vertical track 62 is substantially parallel to door 4 when door 4 is in its closed position. Vertical track 62 is attached to wall structure 70 with a metal reverse angle track shield 80 and bracket material using conventional fasteners such as screws, bolts, and rivets. Reverse angle track shield 80 is typically made of a solid metal strip that allows no gaps between the mounting surface or wall and support track 6. Reverse track angle shield 80 prevents objects, such as arms, hands, fingers and the like from being placed between the sectional door 2 and supporting surface during operation of the door. There are no holes in either track 62 or reverse angle track shield 80 exceeding 0.350".

Track 66 further includes a plurality of knockout latch openings 81, which may be removed when a latch is provided on door 2 as a security measure. Each latch opening that is knocked out to accommodate a latch (not shown) is further covered by a latch opening shield 83, which securely and non-movably clips onto track 66 on the side opposite from which the latch would engage. Latch opening shield 83 covers a latch opening when the door 2 is in operation or when the latch is not engaged within latch opening 81.

Further, the track sections 62–66 have gaps where they connect together as well as discontinuities for the roller shield to travel. The protective wings or flanges of the roller shield can bind in the gaps. The wings are designed so as to have fingers or guides to keep the shield from binding or catching on the gaps between the track sections. This way the shield maintains a fixed orientation with respect to the track. This fixed orientation keeps the shield in the optimal position for preventing objects, such as fingers or other body parts, from catching with the track by the roller wheels.

Horizontal track 66 is typically attached at its end 68 to a building ceiling structure 72 using metal angle and bracket material and conventional fasteners. Horizontal track 66 is typically also attached to horizontal track angle 82, which connects with vertical reverse track angle shield 80 near wall structure 70. Arcuate track 64, which is at the front part of horizontal track 66 is directly attached to vertical track 62 and horizontal track 66 through a connecting bracket 69 using conventional fasteners and main optionally, be attached to the building structure or a track angle. Further, tracks 62–66 may be constructed of one unitary piece formed with the arcuate track section 64 to provide both the horizontal, curved, and vertical sections. Likewise, in buildings having exceptionally high ceilings, no horizontal section or arcuate section would be necessary.

Torsion spring assembly 39, as shown in FIG. 1, comprises a torsion shaft 41 that spans between novel lock-on side bearing brackets 84, which contain bearings 86 that support torsion shaft 41 and allow torsion shaft 41 to rotate freely. While torsion shaft 41 extends the entire width of the doorway, torsion shaft 41 may have one or more sections that are connected in a manner that will allow torque to be transmitted between each section. Torsion shaft 41 may also be supported by intermediate bearing brackets 37 which contain bearings and allow torsion shaft 41 to rotate freely within the bracket bearing. Torsion assembly 39 is generally located adjacent to the wall and immediately above the doorway as shown in FIG. 2, or to the rear of the horizontal track 66. Lock-on side bearing brackets 84 may attach to horizontal track angles 82 with conventional fasteners. Lock-on side bearing brackets 84 may also be attached to the wall structure 70 with conventional fasteners such as lag screws.

Figure 2B:
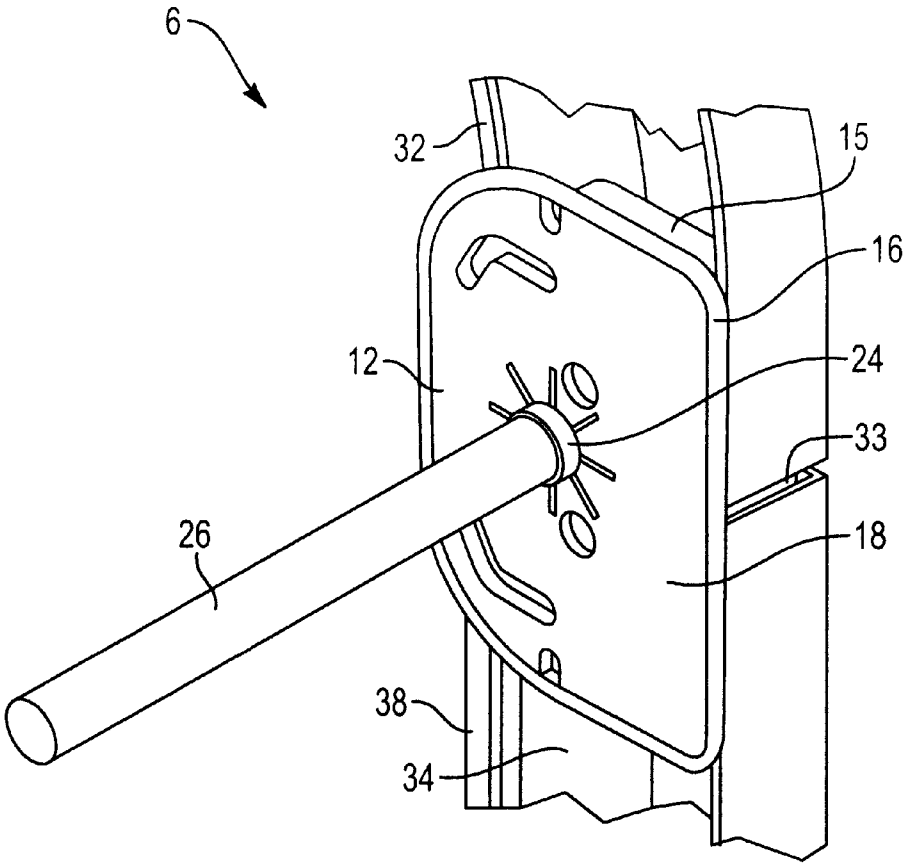
FIG. 2 is a perspective view of a D-shaped roller shield in cutaway view in FIG. 2A and as mounted on the roller axle in FIG. 2B.
Figure 2A:
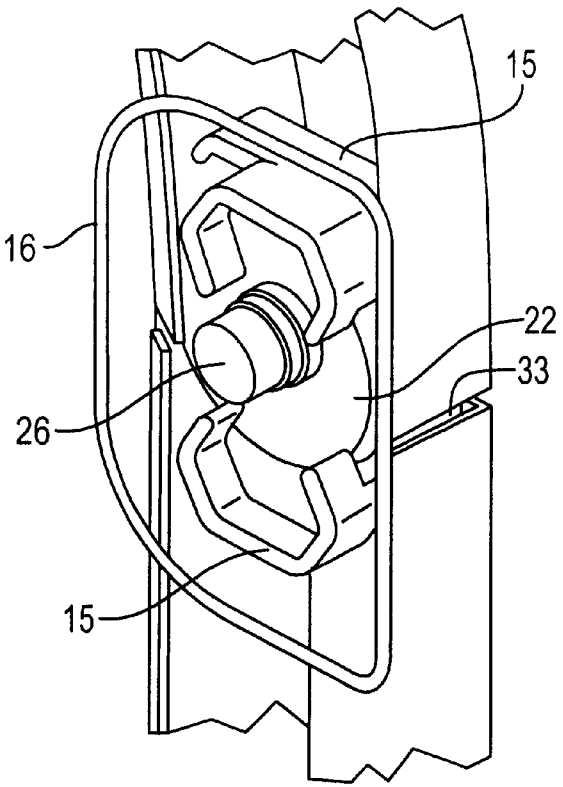

FIG. 2A illustrates a perspective view of a support roller 10, which includes a ghosted image of the protective shielding device in accordance with the present invention. FIG. 2B is similar to FIG. 2B, but is an full perspective view of the same support roller 10 with the shielding device in full view. FIGS. 2A and 2B will be described simultaneously and throughout the following description reference to the drawings is such that like parts are designated by like numerals throughout and taken in conjunction with the appended claims.

Figure 4:
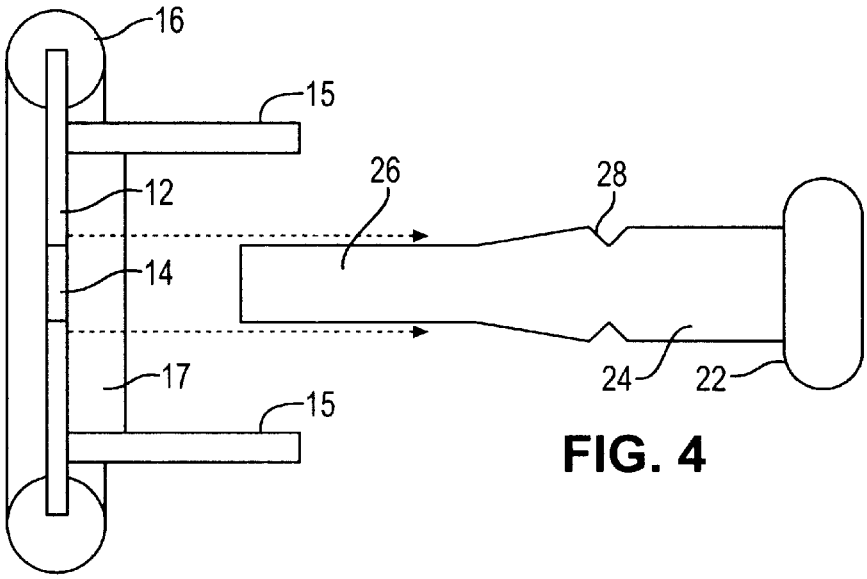
FIG. 4 is a cross-sectional side view of the roller shield being placed upon the support axle proximate the support roller.
Figure 7A:
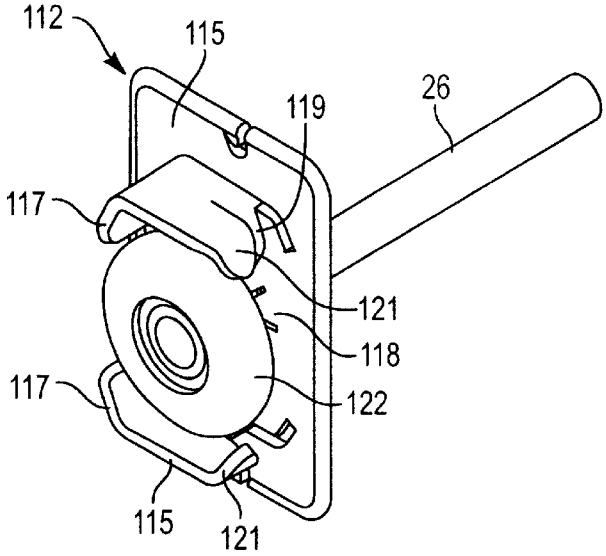
FIG. 7A depicts a perspective view of a roller assembly with a rectangular shaped protective roller shield, which is an alternative embodiment of the present invention.
Figure 7B:
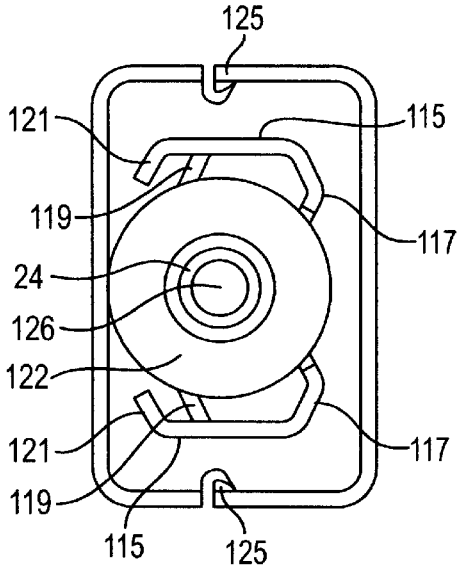
FIG. 7B depicts a side plan view of the roller assembly of FIG. 7A.

Each support roller 10 includes a protective roller shield 12 having a center hole 14, a pair of opposing support roller shield wings 15, an outer perimeter or rim 16, and a pair of track misalignment guides 17 and 19. Roller shield 12 further includes a circumferential bevel around the periphery of center hole 14. The bevel is designed to enable center hole 14 to be fixedly retained within circumferential groove 28 (FIG. 4). In this view, shield 12 has a "D" shape to enhance the protective abilities along the perimeter. Other shapes include rectangular, as shown in FIGS. 7A and 7B, generally rectangular with protective notches, shown in FIG. 10, trapezoidal (not shown), or oval (not shown). The notches may be either circular, U-shaped, or V-shaped. Other shapes of the shield, as well as notch configurations, will be readily apparent to those skilled in the art.

Protective roller shield 12 operates in conjunction with support roller assembly 20 that is mounted to sectional door 8 of FIG. 1 and engaged in support track 6. Support roller assembly 20 is a conventional support roller assembly and includes a support roller 22 rotatably mounted to a neck 24, which is formed as a diametrically enlarged section on the end of an axle 26. Circumferential groove 28 is formed in neck 24 to engage protective roller shield 12 therein in a snap-fit relationship. Specifically, the dimensions of center hole 14 are set to match the dimensions of circumferential groove 28 so that protective roller shield 12 can be forced over neck 24 until center hole 14 is received in circumferential groove 28. A plurality of radial tines 18 extend inwardly towards center hole 14 and provide sufficient resiliency in roller shield 12 to accommodate center hole 14 being forced over neck 24. Bevel 19 also snugly nests center hole 14 in circumferential groove 28.

Support track 6 is a vertical section of support track for the sectional door 2 and works in tandem with protective shield roller shield 12 to prevent cuts and injuries to anyone who accidently gets their fingers inside track 6 while the door 2 is being opened or closed. Support track 6 is fabricated from a strip of sheet metal that has been formed into the particular J-shape or modified C-shaped profile shown in FIGS. 6 and 9 and includes a curved section 32, a leg section 34, and an L-shaped overhang or flange section 36, which creates the generally C-shaped cross sectional profile to the overall appearance of support track 6. The exposed edge of curved section 32 is folded into an outwardly formed single hem 38, which is preferred so as to minimize damage to the rollers traversing within track 6. Alternative hems or protective edges for the exposed edge are illustrated in FIG. 6. The presence of single hem 38 provides a smooth edge to curved section 32, thereby eliminating any danger of a finger being cut upon this edge.

Figure 3:
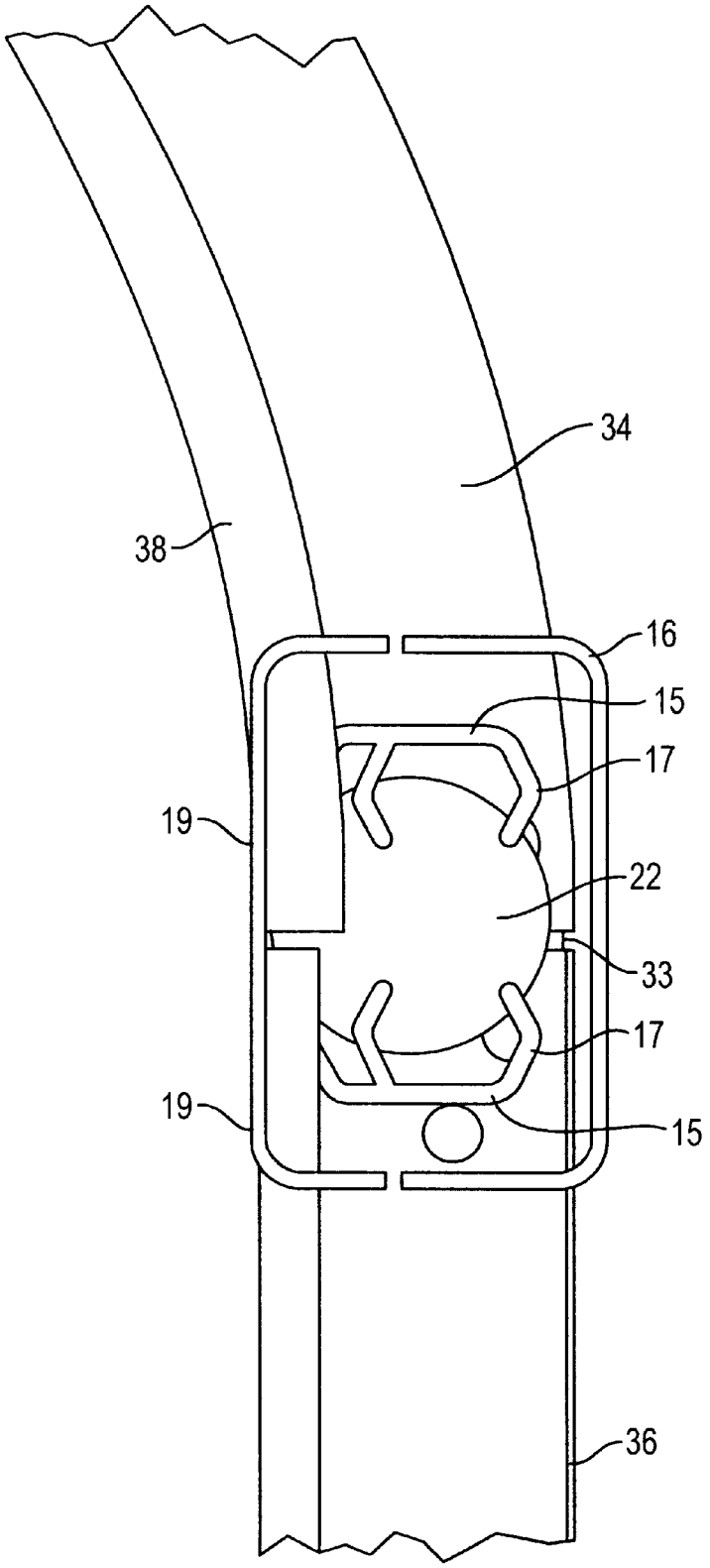
FIG. 3 is a side view of the roller shield of FIG. 2 where the wings aid in transition from a first track section to a second track section.

Support roller 22 is designed to travel along the length of curved section 32 of support track 6 and is retained in support track 6 by the presence of flange section 36 as illustrated in FIG. 3. Support track 6 is configured to be rigid in order to both support the sectional door and to withstand the forces imposed thereon when the sectional doors move between its open and closed positions. Accordingly, each sectional door is supported on support track 6 by a plurality of roller supports 10.

Protective roller shield 12, once mounted to roller assembly 20, becomes a permanent part of roller assembly 20. The diameter of roller shield 10 is also sufficiently larger than support roller 22 to cause roller shield 12 to extend beyond the external periphery of both overhang section 36 and curve section 32. This encloses the side opening of support track 6 thereby shielding support roller 22 inside support track 6. The allowable spacing between track 6 and roller shield 12 ranges between ⅛"–¼", with ⅛" being preferred. Any closer and roller shield 12 tends to bind with track 6 during operation. Any greater and the fingers of an individual can slip into the track and possibly be harmed during operation.

Additionally, shield wings 15 extend into the track 6 and shield support roller 22 from items that may get past edge 16. Shield wings are made of the same material as roller shield 12. The extension of shield wings 15 into the channel formed by track 6 also prevents children from touching the support rollers at any time. Track misalignment guides 17 and 19 serve to prevent objects from entering the track a the space formed by hem 38 not extending as far toward roller shield 12 as section 36. Guides 17 and 19 also allow for and corrects track mismatch at joint 33. The width of wings 15 is approximately the distance between the edge formed by hem 38 and section 36. Guides 17 and 19 are designed to fit adjacent roller 22 in a protective fashion as illustrated in FIG. 3. Guides 17 and 19 form a C-shaped enclosure that opens inwardly to allow the wing shaped fingers of guides 17 and 19 to travel along the edges of track 30. During transition, the wing shapes of guides 17 and 19 prevent roller shield 12 from catching at the transition point 33. This leads to smoother operation with less binding during opening or closing of the sectional door. Further guides 17 and 19 serve to maintain the orientation of shield 12 relative to the track orientation during travel.

Figure 5:
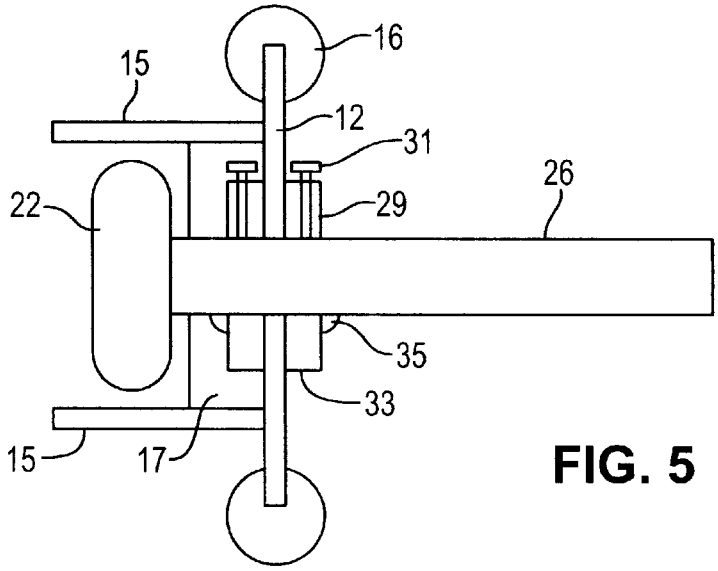
FIG. 5 is a cross-sectional side view of the protective roller shield mated to the support axle in alternative embodiments.

FIG. 4 illustrates a cut away side view of protective roller shield 12 being inserted upon axle 26. As roller shield 12 slides over axle 26, the center hole 14 engages axle 26 and expands because of tines 18 as roller shield 12 extends over the thickened portions that form bevel 28. The diameter of bevel 28 is approximately the same as that of center hole 14. Shoulder 24 prevents roller shield 12 from sliding closer to roller 22. Shield wings 15 extend a distance sufficient to cover roller 22 as shown in FIG. 5. Guide 17 may connect the wings 15 on edges on the same side and serves to prevent objects from slipping past hem 38. Alternatively, as shown in the cross sectional side plan view of FIG. 5, roller shield 12 can be mated to axle 26 via an annular supporting ring 29, which includes a retaining screw 31. Retaining screw 31 is utilized to fit annular retaining ring 29 in a fixed position along shaft axle 26. A pair of such annular retaining rings are provided to secure roller shield 12 in place. Alternatively, a retaining annular ring 33 may be utilized that lacks the securing screw 31 used in annular ring 29. Annular ring 33 is retained in place via a solder bead 35 that connects annular ring 33 to axle 26. Using either annular ring 29 or 33 eliminates the need for tines 18 of FIG. 2.

Figure 6A:
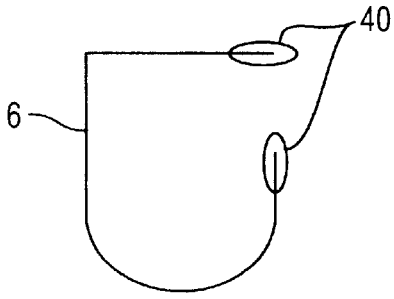
FIG. 6 depicts alternative embodiments of the hem fold used along the exterior edges of the support track of FIG. 2.
Figure 6B:
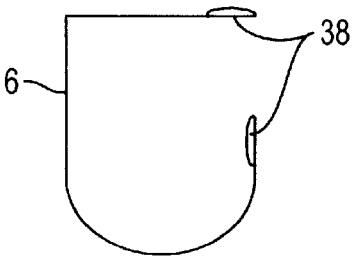
Figure 6C:
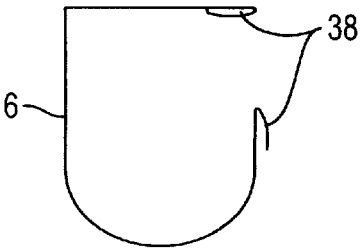

FIGS. 6A, 6B, and 6C illustrate alternative embodiments of hem 38 or protective element 40 placed on the outer edge of support track 6. In FIG. 6A, which illustrates a cross sectional side view of support track 6, a covering 40 can be placed over each edge to protect the sharp metal edge from cutting into a finger pressed against the edge. Likewise, in FIGS. 6B and 6C, hem 38 can be either inward or outward and can be placed on both edges or on just one edge.

FIG. 7A illustrates a perspective view of a generally rectangular protective shield 112 that is similar to D-shaped roller shield 12. FIG. 7B illustrates a plan view of the shield and roller assembly of FIG. 7A. Shield 112 includes a pair of opposably mounted shield wings 115. Wings 115 are generally curved to conform to the curve of roller 22. A track misalignment guide 117 is provided to connect wings 115. Guide 117 provides rigidity as well as prevents objects from slipping past hem 38 of track 6. Further guide 117 serves to correct for track mismatch at the joints, as previously described. A second guide 119 is provided opposite guide 17 and serves the same purpose, but along the interior space between the roller 122 and shield 112. A third guide 121 is provided on the same side as guide 19, but in the same plane as roller 122. The roller shield 112 includes a support aperture 114 for mounting on the shaft of the roller 22. The corners of disk 112 are rounded as well to provide for extra safety protection. Furthermore, the perimeter edge 116 is rounded to avoid any unnecessary sharp edges.

Figure 8A:
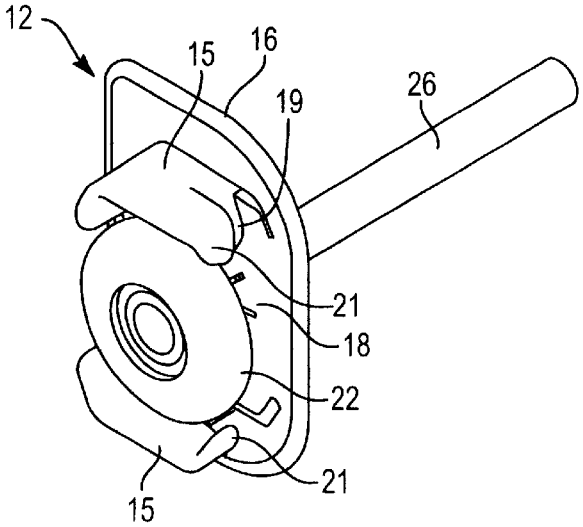
FIG. 8A depicts a perspective view of the roller assembly with a D-shaped roller shield in accordance with the present invention.
Figure 8B:
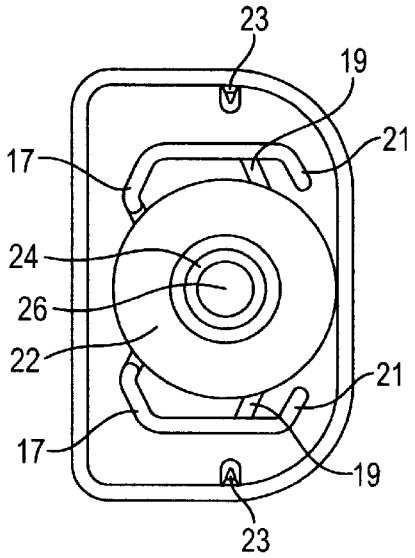
FIG. 8B depicts a side plan view of the roller assembly of the protective roller shield of FIG. 8A.
Figure 9:
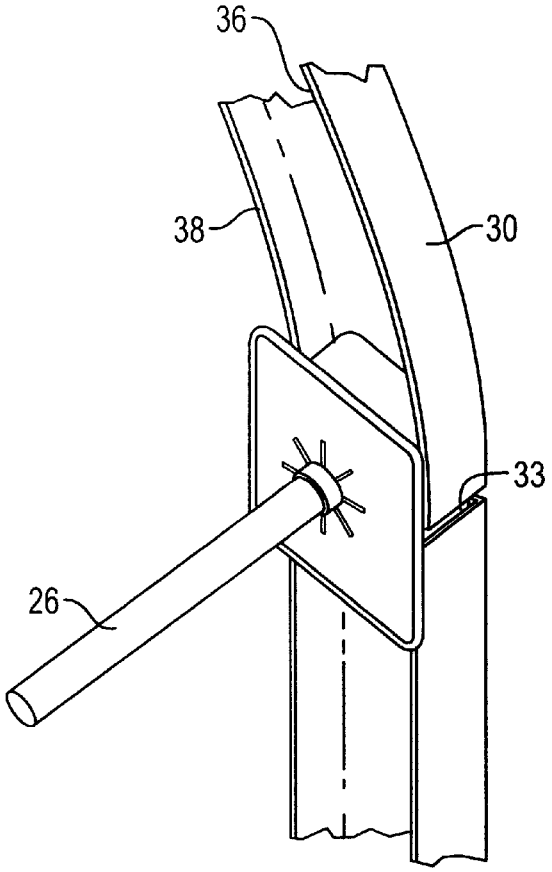
FIG. 9 depicts the roller assembly passing from one track section to another track section in accordance with the present invention.

FIG. 8A illustrates a perspective view of D-shaped shield 12 with FIG. 8B illustrating a front plan view of the shield of FIG. 8A. The dimensions of shield 12 are such that the width extends over both hem 38 and edge section 36 of track 6.

Figure 10:
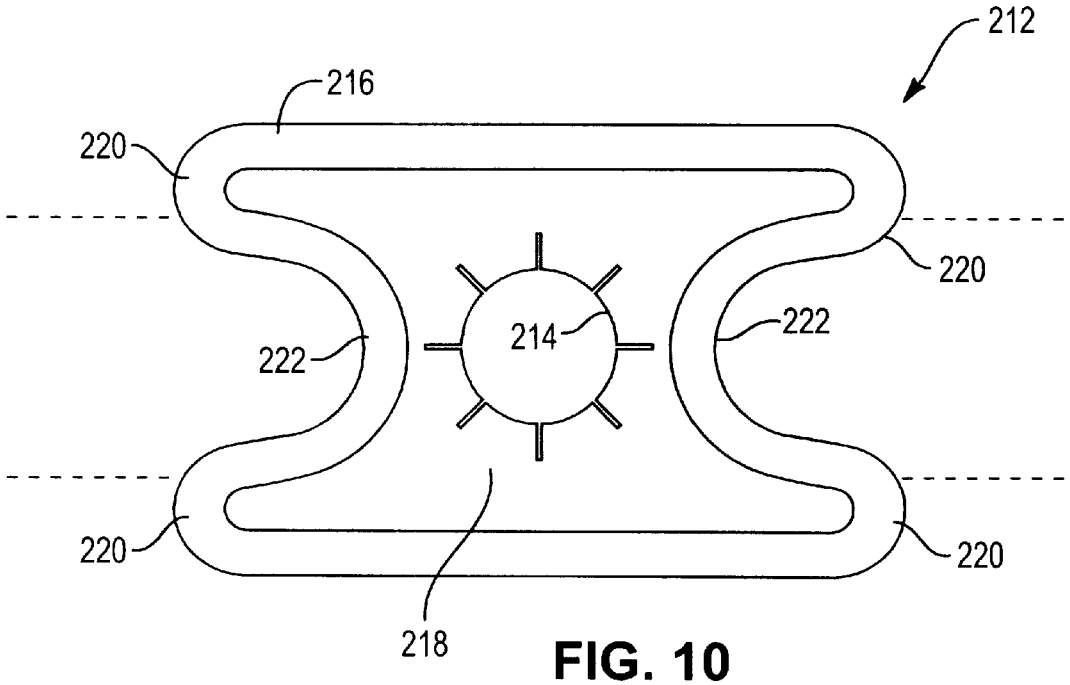
FIG. 10 is a side elevation of the roller shield mounted to the axle of a support roller operating in a support track illustrating a finger being placed proximate the support track.

FIG. 10 illustrates an alternative shape for roller shield 212. Shield 212 is constructed so that concave edges are formed to prevent any object from being caught between the rollers and the track. The concave edges 222 lead to rounded points 210 that fall outside the path of the track, shown in ghosted form. A protective edge 216, like that of edge 16 of shield 12 is also provided. Tines 218 are provided to allow shield 212 to snap into place along circumference 214. Although concave edge 222 is illustrated to be semicircular, it may also be V or U-shaped as long as it is aligned with the track so as not to pinch or cause an object to bind between shield 212 and the track.

Figure 11A:
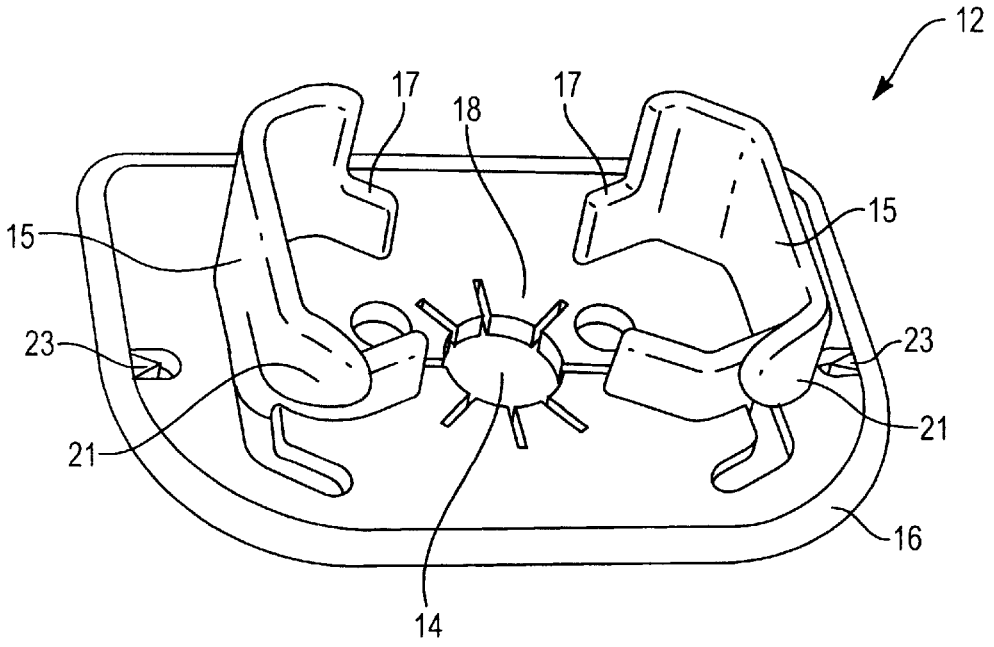
FIG. 11A is a perspective view of the wing side of the roller shield in accordance with principles of the present invention.
Figure 11B:
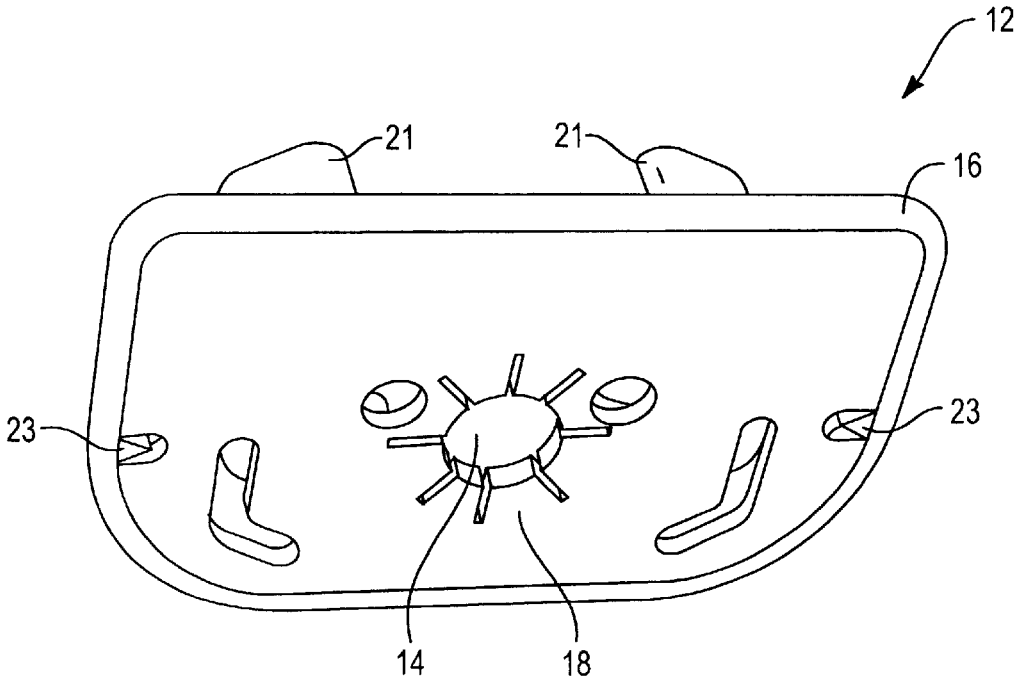
FIG. 11B is a perspective view of the roller shield on the opposite side of the wing side of FIG. 11B.
Figure 12:
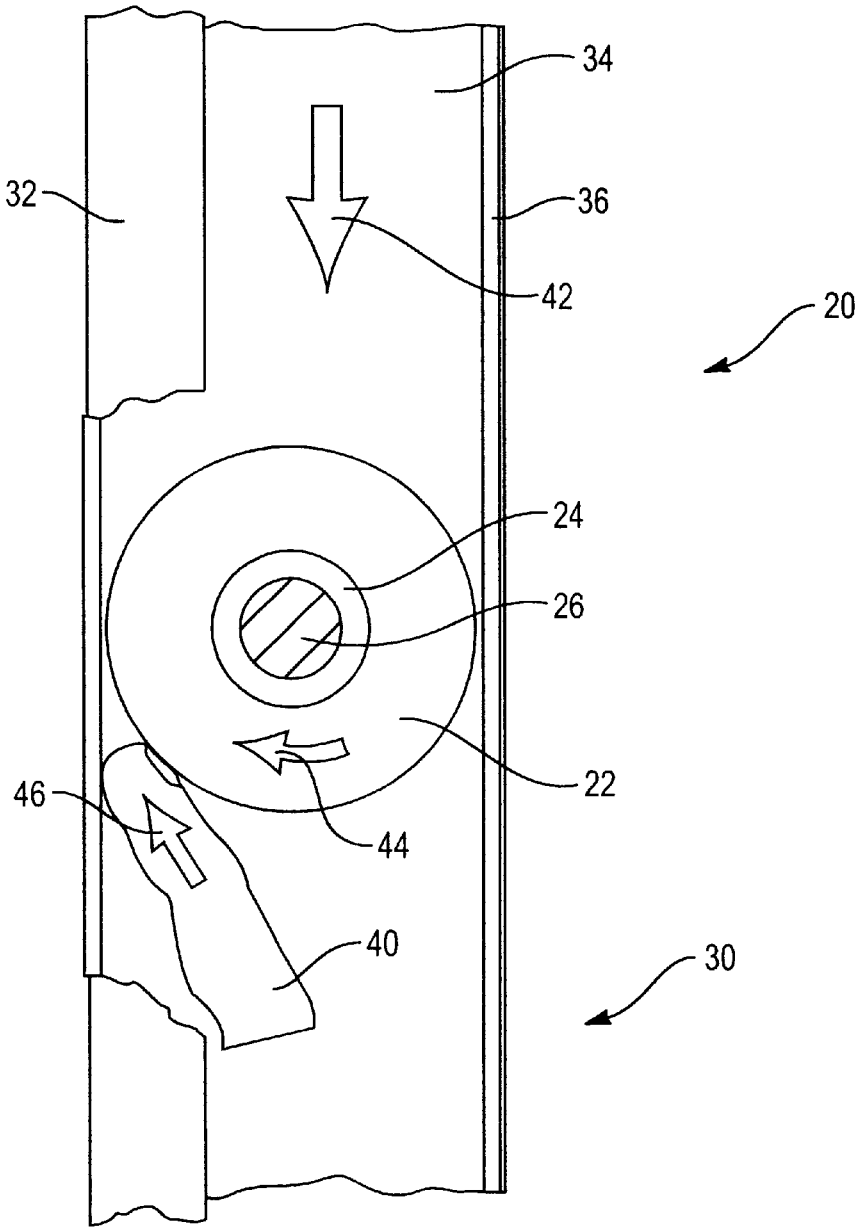
FIG. 12 (Prior Art)
FIG. 12 (PRIOR ART) is a side elevation of a support roller operating in a support track in the absence of the protective roller shield with portions of the support track cut away for ease of presentation and shown in the environment of a person's finger.

FIG. 11A illustrates a perspective view of the wings 15 of shield 12 while FIG. 11B illustrates a perspective view of the protective face of shield 12 in accordance with the present invention. Further shown are hooks 23 that are placed on opposite ends of shield 12 and are used for alignment purposes of shield 12 during installation.

The present invention may be embodies in other specific forms without department from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A sectional door comprising:

a plurality of door sections movably coupled together, each door section having a first and second end;

first and second support tracks positioned oppositely one another and along the respective first and second ends of the plurality of door sections, each support track having a first edge, a second edge, a channel adjacent the first edge and wherein the first edge is hemmed along its length;

first and second reverse angle track shields, connected to the first and second support tracks, respectively, to connect the support tracks to a mounting surface and to prevent an object from passing between the support tracks and the mounting surface;

a plurality of support rollers, each support roller coupled to a first or second edge of the plurality of the door sections and engaged with one of the first and second support tracks, each support roller further comprising:

a support axle;

a roller mounted to a first end of the support axle; and a protective roller shield, which has a concave first edge and a concave second edge, placed opposite the first edge and having guide elements at each corner of the roller shield formed by the concave edges, having an area larger than the roller and axially mounted to the support axle proximate the roller and the first edge of one of the first or second support tracks and further having an enlarged edge along the perimeter of the protective roller shield, the roller shield further including a pair of shield wings mounted on a first side of the roller shield in an arrangement for shielding the support roller within the support track, the shield wings further including transport guides to prevent the protective roller shield from binding in the support track.

2. The sectional door according to claim 1 wherein the protective roller shield further includes a plurality of resilient radial tines defining an opening to receive the support axle.

3. The sectional door according to claim 1 wherein the second edge of each support track is hemmed along its length.

4. The sectional door according to claim 3 wherein the hem along the first edge is formed outward of the channel.

5. The sectional door according to claim 1 wherein the roller shield is spaced between ⅛"–¼" from the support track.

6. The sectional door according to claim 1 wherein each roller shield is located approximately ⅛" from the support track.

7. The sectional door according to claim 1 wherein each support track is comprised of at least two track sections that meet at a transition point along the channel.

8. A sectional door roller wheel apparatus for use on a sectional door that is retained by a pair of support tracks, the apparatus comprising:

a plurality of support rollers, each support roller being designed to couple to a first or second edge of the sectional door and to engage with one of the pair of support tracks, each support roller further comprising:

a support axle;

a roller mounted to a first end of the support axle; and a protective roller shield having a concave first edge and a concave second edge, opposite the first edge with guide elements at each corner of the roller shield formed by the concave edges having an area larger than the roller and axially mounted to the support axle proximate the roller and further having an enlarged edge along the perimeter of the protective roller shield and a pair of shield wings mounted on a first side of the roller shield in an arrangement for shielding the roller when placed within a support track, the shield wings further including transport guides.

9. The apparatus according to claim 8 wherein the protective roller shield further includes a plurality of resilient radial tines defining an opening to receive the support axle.

10. The apparatus according to claim 8 wherein the shield wings maintain directional orientation of the protective roller shield along a path of travel along the support track.

11. The apparatus according to claim 8 wherein the roller shield mounted on the axle adjacent the support roller to allow a space between ⅛"–¼" from the support track when located therein.

12. The apparatus according to claim 8 wherein each roller shield is located approximately ⅛" from the support track.

13. The apparatus according to claim 8 wherein each roller shield further comprises a pair of mounting hooks.

* * * * *